US009153225B2

(12) United States Patent
Bonifas

(10) Patent No.: US 9,153,225 B2
(45) Date of Patent: Oct. 6, 2015

(54) SOUND ENCLOSURE FOR ENCLOSING A COMPRESSOR ASSEMBLY

(71) Applicant: Emerson Climate Technologies, Inc., Sidney, OH (US)

(72) Inventor: Mark A. Bonifas, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 371 days.

(21) Appl. No.: 13/681,587

(22) Filed: Nov. 20, 2012

(65) Prior Publication Data

US 2013/0156614 A1 Jun. 20, 2013

Related U.S. Application Data

(60) Provisional application No. 61/576,670, filed on Dec. 16, 2011.

(51) Int. Cl.
*G10K 11/16* (2006.01)
*F04B 39/00* (2006.01)

(52) U.S. Cl.
CPC ..... *G10K 11/16* (2013.01); *F04B 39/0033* (2013.01); *Y10T 29/49947* (2015.01)

(58) Field of Classification Search
CPC ..... F04B 39/0033; G10K 11/16; Y10T 29/49947
USPC ..... 181/198, 200, 202
See application file for complete search history.

(56) References Cited

U.S. PATENT DOCUMENTS

| | | | |
|---|---|---|---|
| 3,187,995 | A | 6/1965 | Kjeldsen |
| 3,589,971 | A | 6/1971 | Reed |
| 3,815,705 | A | 6/1974 | Bennett |
| 3,929,207 | A | 12/1975 | Urban |
| 3,960,237 | A | 6/1976 | Sleeper |
| 4,110,876 | A | 9/1978 | Weiss et al. |
| 4,347,043 | A | 8/1982 | Morris |

(Continued)

FOREIGN PATENT DOCUMENTS

| | | | |
|---|---|---|---|
| CN | 2203928 | Y | 7/1995 |
| CN | 1206794 | A | 2/1999 |

(Continued)

OTHER PUBLICATIONS

The Trane Company, "Trane.TM. XL 1200 Super Efficiency Weathertron.RTM. Heat Pump" Pub. No. 72-1027-2, American Standard Inc. 1986, 4 Pages.cited by other.

(Continued)

*Primary Examiner* — Jeremy Luks
(74) *Attorney, Agent, or Firm* — Harness, Dickey & Pierce, P.L.C.

(57) ABSTRACT

A sound enclosure for enclosing a compressor assembly in an assembled state can include at least one cover piece, a shoe member, and a base. The shoe member can include a partial circumferential wall that projects upright from a generally planar portion. One of the partial circumferential wall or the cover piece has a projected portion. The other of the partial circumferential wall or the cover piece has a recessed portion. In the assembled state, the projected portion nests into the recessed portion. The base includes an outer contact area. The shoe member includes an outer perimeter. In the assembled state, the outer contact area is in contact with the outer perimeter of the shoe member.

19 Claims, 6 Drawing Sheets

(56) References Cited

U.S. PATENT DOCUMENTS

| | | | |
|---|---|---|---|
| 4,453,887 | A | 6/1984 | Schucker |
| 4,624,339 | A | 11/1986 | Marcel et al. |
| 4,834,625 | A | 5/1989 | Grant |
| 4,892,413 | A | 1/1990 | Vats |
| 4,914,929 | A | 4/1990 | Shimazaki |
| 4,982,812 | A | 1/1991 | Hwang |
| 4,991,406 | A | 2/1991 | Fujii et al. |
| 5,151,018 | A | 9/1992 | Clendenin et al. |
| 5,272,285 | A | 12/1993 | Miller |
| 5,274,200 | A | 12/1993 | Das et al. |
| 5,588,810 | A | 12/1996 | DiFlora et al. |
| 5,881,990 | A | 3/1999 | Kawamura |
| 5,945,643 | A | 8/1999 | Casser |
| 5,997,258 | A | 12/1999 | Sawyer, III et al. |
| 6,062,033 | A | 5/2000 | Choi |
| 6,234,136 | B1 | 5/2001 | Choi et al. |
| 6,604,603 | B1 | 8/2003 | Wirth |
| 6,872,057 | B2 | 3/2005 | Kim |
| 6,893,711 | B2 | 5/2005 | Williamson et al. |
| 6,932,190 | B2 | 8/2005 | Sishtla |
| 7,357,219 | B2 | 4/2008 | Mafi et al. |
| 7,398,855 | B2 | 7/2008 | Seel |
| 2005/0056481 | A1 | 3/2005 | Mafi et al. |
| 2008/0099275 | A1 | 5/2008 | Seel |
| 2008/0173497 | A1 | 7/2008 | Kalinova et al. |
| 2010/0108854 | A1 | 5/2010 | Logan |

FOREIGN PATENT DOCUMENTS

| | | | |
|---|---|---|---|
| CN | 101550939 | A | 10/2009 |
| CN | 203114559 | U | 8/2013 |
| EP | 0 388 525 | A1 | 9/1990 |
| FR | 2732099 | A1 | 9/1996 |
| GB | 2295436 | A | 5/1996 |
| JP | 1210735 | A | 8/1989 |
| JP | 2163479 | A | 6/1990 |
| JP | 06067678 | A | 3/1994 |
| KR | 2001-0011705 | A | 2/2001 |
| KR | 2002-0044428 | A | 6/2002 |
| KR | 2003-0042352 | A | 5/2003 |
| KR | 2004-0009063 | A | 1/2004 |

OTHER PUBLICATIONS

Office Action regarding Mexico Patent Application No. MX/a/2012/014693, dated May 21, 2015. Summary translation provided by Goodrich, Riquelme y Asociados.

First Chinese Office Action regarding Application No. 201210545863.8, dated Feb. 28, 2015. Translation provided by Unitalen Attorneys at Law.

SOUND ENCLOSURE FOR ENCLOSING A COMPRESSOR ASSEMBLY

CROSS-REFERENCE TO RELATED APPLICATIONS

This application claims the benefit of U.S. Provisional Application No. 61/576,670, filed on Dec. 16, 2011. The entire disclosure of the above application is incorporated herein by reference.

FIELD

The present disclosure relates to a sound enclosure for enclosing a compressor assembly.

BACKGROUND

This section provides background information related to the present disclosure and is not necessarily prior art.

Compressors are used to compress refrigerant in heating, ventilation, and air conditioning systems. Hermetic compressor assemblies are used as one method of compressing refrigerant gases. Among other applications, compressor assemblies may be included in a condenser unit of an air conditioning system to compress refrigerant. Installing the compressor assembly into the condenser unit may require different components of the compressor assembly to be shipped separately from one another. Shipping separate components may significantly increase shipping costs, compressor assembly times, and compressor assembly costs for the condenser unit manufacturer.

SUMMARY

This section provides a general summary of the disclosure, and is not a comprehensive of its full scope or all of its features.

A sound enclosure for enclosing a compressor assembly in an assembled state can include at least one cover piece, a shoe member, and a base. The shoe member can include a partial circumferential wall that projects upright from a generally planar portion. One of the partial circumferential wall or the cover piece has a projected portion. The other of the partial circumferential wall or the cover piece has a recessed portion. In the assembled state, the projected portion nests into the recessed portion. The base includes an outer contact area. The shoe member includes an outer perimeter. In the assembled state, the outer contact area is in contact with the outer perimeter of the shoe member.

According to other features, the shoe member includes first and second shoe members each having a joint area. One of the joint area of the first shoe member or the joint area of the second shoe member has an extending portion. The other of the joint area of the first shoe member or the joint area of the second shoe member has a depressed portion. In the assembled state, the extending portion nests into the depressed portion.

According to still other features, the first shoe member includes a first partial circumferential wall that projects upright from a first generally planar portion. The second shoe member includes a second partial circumferential wall that projects upright from a second generally planar portion. The extending portion is formed on both of the first partial circumferential wall and the first generally planar portion. The depressed portion is formed on both of the second partial circumferential wall and the second generally planar portion.

In one configuration, the first partial circumferential wall overlaps the second partial circumferential wall at the joint area. The at least one cover piece overlaps the first partial circumferential wall at the joint area. A portion of the partial circumferential wall or a portion of the cover piece, one of a portion of the outer contact area or the outer perimeter, or one of the extending portion or depressed portion of the joint area can be lined with isolating material.

In one configuration, the outer contact area of the base can include a radially extending portion. The outer perimeter of the shoe member can define an annular groove. In the assembled state, the radially extending portion nests into the annular groove. The at least one cover piece can include a first cover piece and a second cover piece. In the assembled state, the first and second cover pieces are fastened to each other. The sound enclosure can further comprise at least one mechanical fastener that couples the first and second cover pieces together. The at least one cover piece can be coupled to the shoe member.

A compressor assembly constructed in accordance to the present disclosure can include a sound enclosure as identified above. The shoe member can define a first aperture. The base can define a second aperture. The compressor assembly can further comprise a hermetic shell including a lower shell member defining a third aperture and a mounting assembly including a fastener and first, second, and third isolation members. In a mounted state, the fastener can extend through the first, second, and third isolation members and secure the sound enclosure to a mounting structure such that a portion of the first isolation member is located within the first aperture and isolates the fastener from the shoe member. A portion of the second isolation member is located within the second aperture and isolates the base from the fastener and the mounting structure. A portion of the third isolation member is located within the third aperture and isolates the lower shell member from the fastener in the base. In the assembled state, the interior surface of the cover piece is lined with a sound attenuating material. In the assembled state, the interior surface of the shoe member is lined with a sound attenuating material.

A method of assembling a sound enclosure that encloses a compressor can include locating the compressor on a base. A first shoe member can be located over a lower shell member of the compressor. A second shoe member can be located over the lower shell member of the compressor. Locating the first and second shoe members can comprise nesting extending portions on one of the first and second shoe members into recessed portions formed on the other of the first and second shoe members. At least one fastener can be advanced through cooperatively aligned apertures in the first and second shoe members.

According to additional features, the method can include engaging a hanger tab extending from the compressor. The compressor, base and first and second shoe members can be moved as a collective unit while applying a force to the hanger tab.

According to still other features, the first and second cover pieces can be located on their respective first and second shoe members. Projected portions of the first and second shoe members can be nested into respective recessed portions of the first and second cover pieces. The first and second cover pieces can be overlapped with partial circumferential walls of the first and second shoe member. Mechanical fasteners can be advanced through the first and second cover pieces.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only and are not intended to limit the scope of the present disclosure.

Corresponding reference numerals indicate corresponding parts throughout the several views of the drawings.

DETAILED DESCRIPTION

Figure 1:
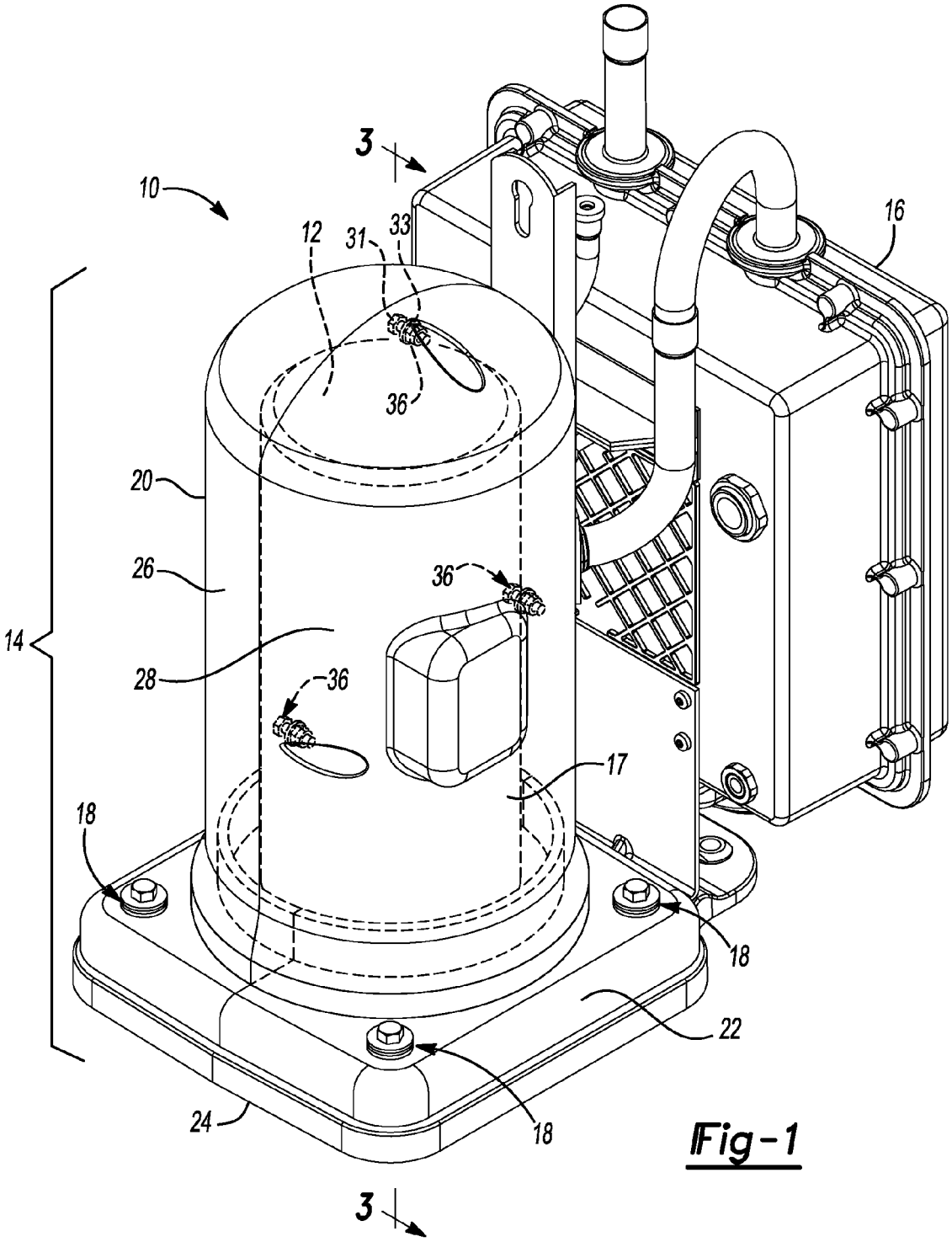
FIG. 1 is a front perspective view of a compressor assembly including a sound enclosure constructed in accordance to one example of the present teachings.

FIG. 1 illustrates a compressor assembly 10 constructed in accordance with one configuration of the present teachings and shown in an assembled state. The compressor assembly 10 includes, among other things, a hermetic compressor 12 located within a sound enclosure 14, an optional electrical inverter drive system (not shown) located within an optional drive enclosure 16, and a mounting assembly 18. The hermetic compressor 12 includes a hermetic shell 17 that hermetically houses the electrical and mechanical components of the compressor 12. The sound enclosure 14 includes a cover piece 20, a shoe member 22, and a base 24. In the assembled state, the sound enclosure 14 may mitigate the intensity of the sound and vibration of the compressor 12 during its operation.

Figure 2:
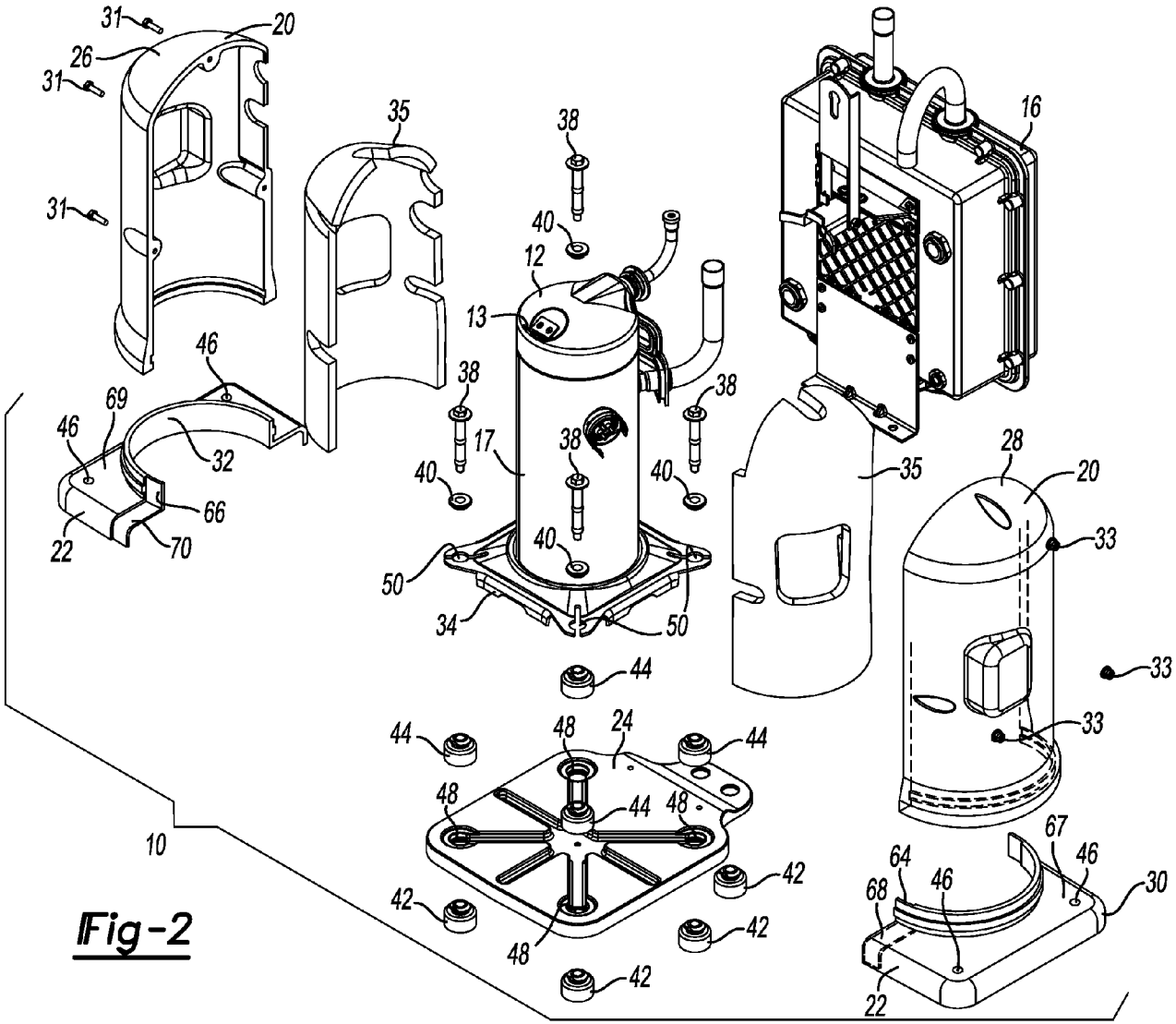
FIG. 2 is an exploded perspective view of the compressor assembly of FIG. 1.

FIG. 2 illustrates the compressor assembly 10 of FIG. 1 in a partially unassembled state. In addition to the compressor 12, the compressor assembly 10 may include (i) the cover piece 20 which includes a first cover piece 26 and a second cover piece 28, (ii) the shoe member 22 which includes a first shoe member 30 and a second shoe member 32, (iii) the optional drive enclosure 16, (iv) the base 24, (v) the hermetic shell 17 which includes a lower shell member 34 and a hanger tab 13, (vi) sound isolation material 35, (vii) a series of mechanical fasteners 36, and (viii) the mounting assembly 18. The mounting assembly 18 includes the series of fasteners 38, first isolation members 40, second isolation members 42, and third isolation members 44. The shoe members 30 and 32 collectively define a series of first apertures 46. The base 24 defines a series of second apertures 48. The lower shell member 34 defines a series of third apertures 50.

In arrangements of the sound enclosure 14 having two cover pieces, the first cover piece 26 and the second cover piece 28 may be generally symmetrical to one another in size and shape. Generally symmetrical should be understood to mean that the cover pieces 26, 28 should have the same overall appearance of size and shape and should fit together in the assembled state to form the cover piece 20. Nevertheless, the cover pieces 26, 28 may not be mirror images one another and one cover piece may have a cut-out or feature that the other does not. The first shoe member 30 and the second shoe member 32 are also generally symmetrical. Therefore, for simplicity, it should be understood that the general description of the cover piece 20 applies equally to both the cover pieces 26, 28. The general description of the shoe member 22 applies equally to both shoe members 30, 32.

The cover pieces 26, 28 may be coupled together by one or more mechanical fastener(s) 36 (as shown coupled in FIG. 1). The mechanical fastener 36 may collectively include a bolt 31 and nut 33. It should be understood, however, that the number and type of mechanical fasteners 36 is not limiting so long as the mechanical fastener 36 functions to couple the cover pieces 26, 28 together.

Figure 3:
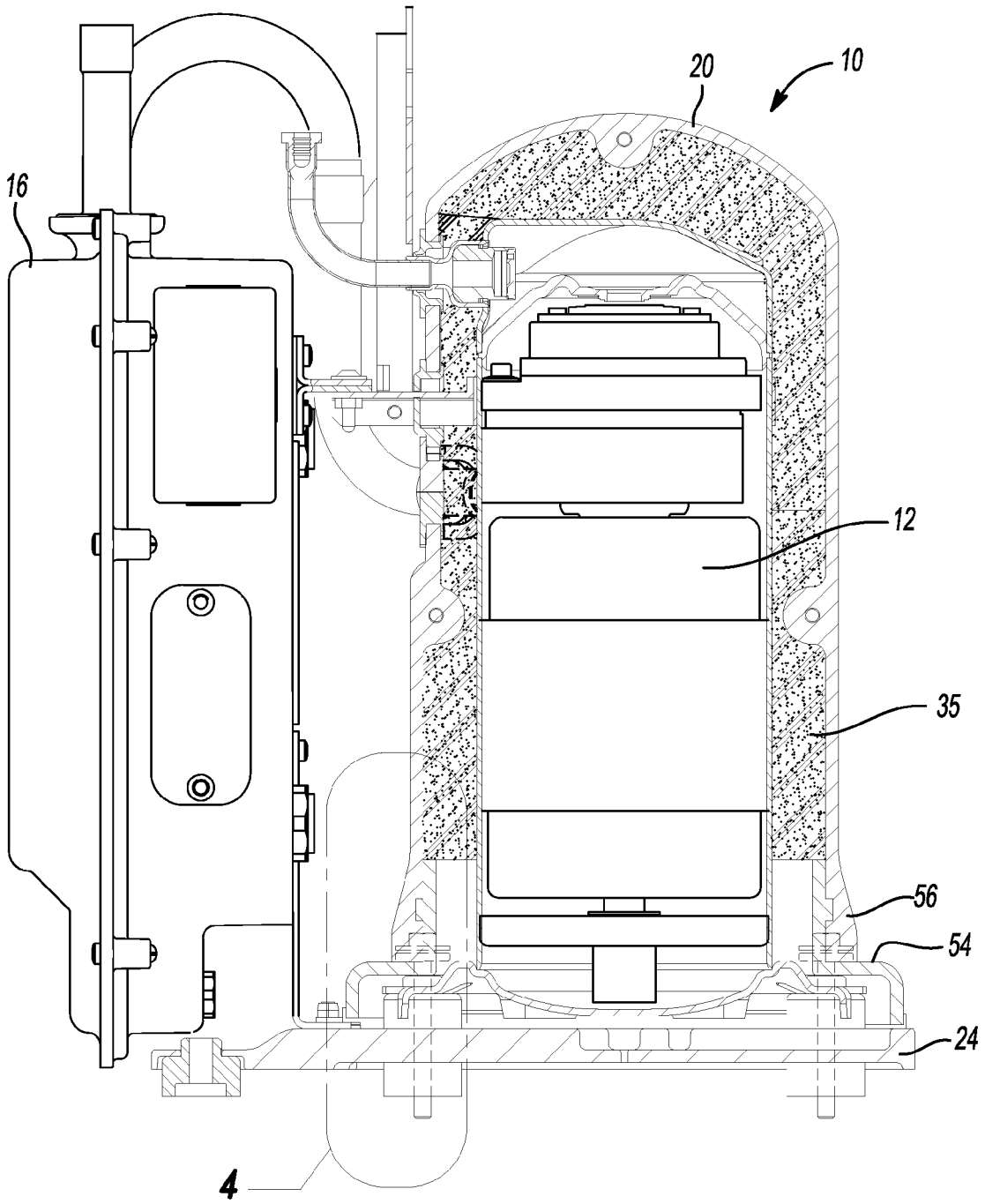
FIG. 3 is a partial sectional view of the compressor assembly of FIG. 1 taken along lines 3-3 of FIG. 1.

The sound insulation material 35 attenuates noise and/or vibration caused by the compressor. It may include fiber glass insulation, polystyrene, or another suitable material used to mitigate sound and/or vibration. As shown in FIG. 3, the sound insulation material may be located between the hermetic shell 17 and the cover piece 20. It may further be located on one more of the interior surface of the shoe member 22 (as shown in FIG. 4) and/or on the interior surface of the base 24 (not shown).

Figure 4:
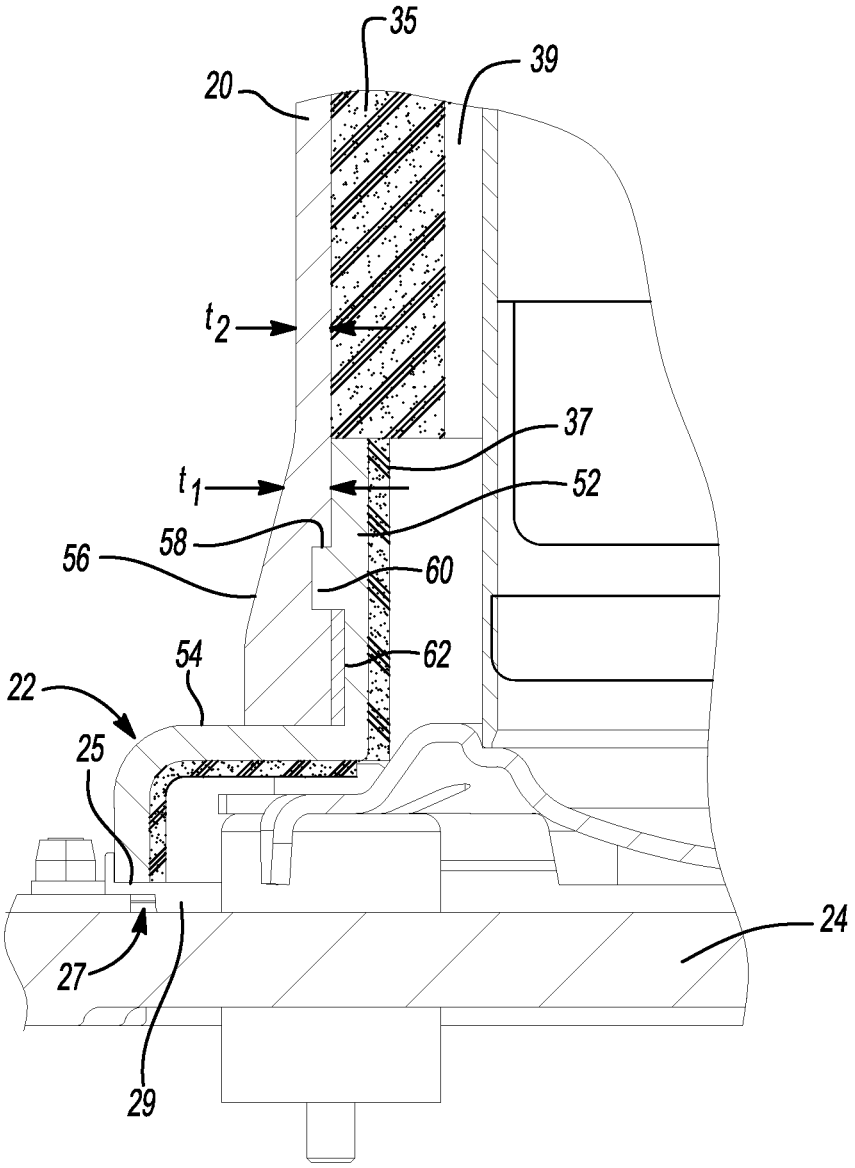
FIG. 4 is a detail view of section 4 in FIG. 3.

FIG. 4 is an expanded perspective of the window of FIG. 3 illustrating the interaction of the cover piece 20, base 24, and shoe member 22. The shoe member 22 includes a partial circumferential wall 52 extending from a generally planar portion 54. The cover piece 20 includes a lower portion 56. The lower portion 56 may have a cross sectional thickness $t_1$ that is progressively greater toward the planar portion 54 and as compared to the cross thickness $t_2$ of the other portions of the cover piece 20. In this example, the cover piece 20 has a recessed portion 58 located in the lower portion 56. The partial circumferential wall 52 has a projected portion 60 located on its exterior surface. In the assembled state the projected portion 60 nests into the recessed portion 58. In other arrangements, the recessed portion 58 may be located on the exterior surface of the partial circumferential wall 52 and the projected portion may be located on the in the lower portion 56.

The projected portion 60 and recessed portion 58 have complementary cross sectional shapes that allow the projected portion 60 to nest into the recessed portion 58. The complementary cross sectional shapes may be a rectangular and/or rounded cross section or may have any other cross sectional shape that allows the projected portion 60 to nest into the recessed portion 58. In some arrangements, a portion of the outer surface of the circumferential wall 52, inner surface of the lower portion 56, recessed portion 58, and/or projected portion 60 may have sound isolation material 62 on one or more of their surfaces. More specifically, for example, the inner surface of the partial circumferential wall 52 and the shoe member 22 may include sound insulation material 37. The sound isolation material attenuates the noise and vibration caused by the compressor 12. The sound isolation material 29, 35, 37, and 62 may be foam, rubber-like material, and/or any other type of material suitable for mitigating noise and vibration. In some arrangements, there may be an air gap 39 between the hermetic shell 17 and the sound insulation materials 35, 37. As shown in FIGS. 5C and 5D, the projected portion 60 and recessed portion 58 may extend for all or a portion of the arc length of the partial circumferential wall 52 and/or the lower portion 56. Furthermore, the partial circumferential wall 52 and/or lower portion 56 may have more than one projected portion 60 and/or recessed portion 58 on their surfaces (not shown).

In one arrangement, the shoe member 22 may include an outer perimeter 25 and the base 24 may include an outer contact area 27. In the assembled state, the outer contact area 27 is in contact with the outer perimeter 25 of the shoe member 22. Furthermore, sound isolation material 29 may be located between the outer perimeter 25 and the outer contact area 27 in order to isolate sound and vibration therebetween and from the compressor 12.

Figure 5A:
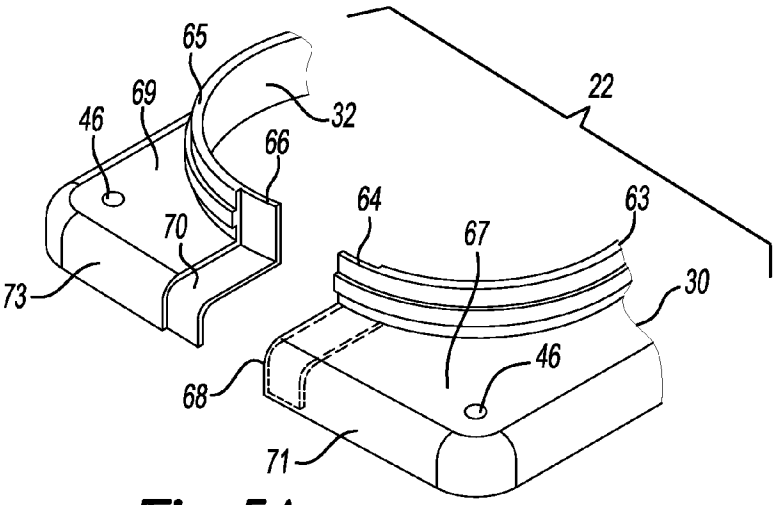
FIG. 5A is an exploded front perspective view of first and second shoe members of the sound enclosure illustrated in FIG. 1.
Figure 5B:
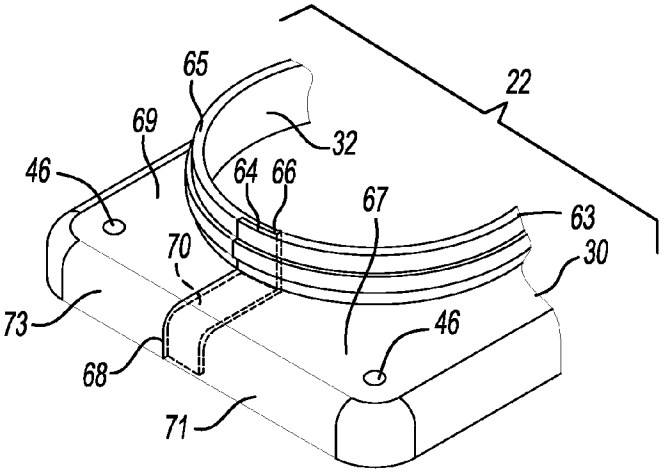
FIG. 5B is a front perspective view of the first and second shoe members shown in FIG. 5A and illustrated in an assembled position.
Figure 5C:
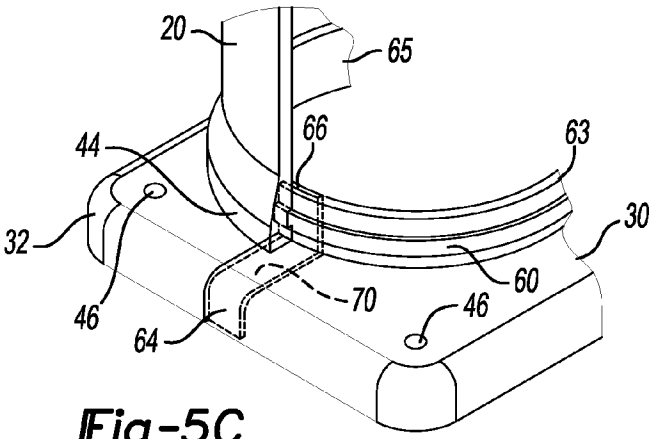
FIG. 5C is a front perspective view of the first and second shoe members illustrated in FIG. 5B and further shown with a first cover piece located against the first shoe member.
Figure 5D:
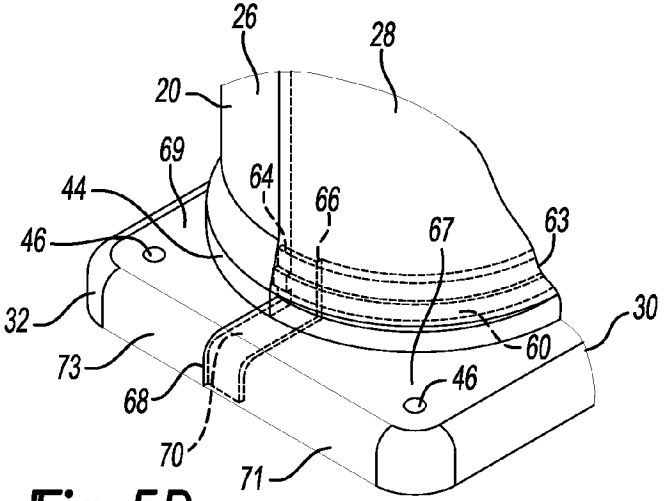
FIG. 5D is a front perspective view of the first and second shoe members shown in FIG. 5C and shown with a second cover piece adjacent the second shoe member according to one example of the present teachings.

FIG. 5A-5D illustrates the interaction of the shoe member 22 with the cover piece 20. FIG. 5A illustrates the first shoe member 30 and the second shoe member 32 in an unassembled state. The first shoe member 30 includes a first partial circumferential wall 63, a first generally planar portion 67, and a first outer perimeter 71. The second shoe member 32 includes a second partial circumferential wall 65, a second generally planar portion 69, and a second outer perimeter 73. The shoe members 30, 32 include joint areas 64 and 66 respectively. The joint area 64 and 66 may be formed on one or all of the partial circumferential walls 63, 65, the generally planar portions 67, 69, and/or the outer perimeters 71, 73.

In this example, the joint area 64 on the first shoe member 30 includes an extending portion 68 and the other joint area 66 on the second shoe member 32 includes a recessed portion 70. It should be understood that the extending portion 68 and recessed portion 70 may be formed on either the first and second shoe members 30, 32. In one arrangement, the extending portion 68 is formed on the first partial circumferential wall 63, the first generally planar portion 67, and the first outer perimeter 71. The recessed portion 70 is formed on the second partial circumferential wall 65, the second generally planar portion 69, and the second outer perimeter 73. FIG. 5B illustrates shoe members 30, 32 of FIG. 5A in the assembled state with the extending portion 68 nesting into the recessed portion 70 such that the first shoe member 30 overlaps the second shoe member 32.

FIG. 5C illustrates an example interaction of the cover piece 20 with the shoe member 22. In this example, the lower portion 56 of the cover piece 20 overlaps the partial circumferential walls 63, 65 such that the projected portion 60 nests into the recessed portion 58. The joint area 64 of the first shoe member 30 overlaps the joint area 66 of the second shoe member 32. Furthermore, some or all of the first cover piece 26 and/or second cover piece 28 may overlap the extending portion 68 of the joint area 64. FIG. 5D illustrates a portion of the sound enclosure 14 in the assembled state. In this arrangement the cover pieces 26, 28 overlap the first and second partial circumferential walls 63, 65.

During assembly of one arrangement of the compressor assembly 10, the compressor 12 may be located on the base 24 such that the series of third apertures 50 on the lower shell member 34 align with the series of second apertures 48 on the base 24. The third isolation members 44 may be located between the third apertures 50 and the second aperture 48. The second shoe member 32 may then be located over the lower shell member 34 such that the first apertures 46 on the second shoe member 32 align with the third apertures 50 on the lower shell member 34. Similarly, the first shoe member 30 may be located over the lower shell member 34 such that the first apertures 46 on the first shoe member 30 align with the third apertures 50 on the lower shell member 34. Locating the shoe members 30, 32 over the lower shell member 34, also includes nesting the extending portions 68 on the first shoe member 30 into the recessed portions 70 on the second shoe member 32 and contacting the outer contact area 27 of the base 24 with the outer perimeters 71, 73 of the shoe members 30 and 32. In this arrangement, the first and second shoe members 30, 32 collectively form the shoe member 22. The first isolation member 40 may then be located in each of the series of first apertures 46 and the fasters 38 displaced through each of the aligned first, second and third apertures 46, 48, 50. In this partially assembled state of the sound enclosure 14, the lower shell member 34 is enclosed within the shoe member 22 and the base 24 and the compressor assembly 10 may be coupled to the mounting structure and/or shipped to the final assembler for final assembly. The hanger tab 13 of the hermetic shell 17 may be used to carry the compressor assembly 10 rather than having to design a durable hanging feature for the sound enclosure 14. In this regard, a force can be applied to the hanger tab 13 to lift and lower the compressor assembly 10 to and from desired locations. To complete final assembly of the sound enclosure 14, the cover pieces 26, 28 may be located on the shoe member 22 such that projected portions 60 of the partial circumferential walls 63, 65 of the shoe members 22 nests recessed portions 58 of the cover pieces 26, 28 and the cover pieces 26, 28 overlap the partial circumferential walls 63, 65. The mechanical fasteners 36 may then secure the cover pieces 26, 28 together. This final step of assembling the cover pieces 26, 28 may be done at either the air conditioning, heating or refrigeration system manufacturer or in the field by a service contractor.

Figure 6:
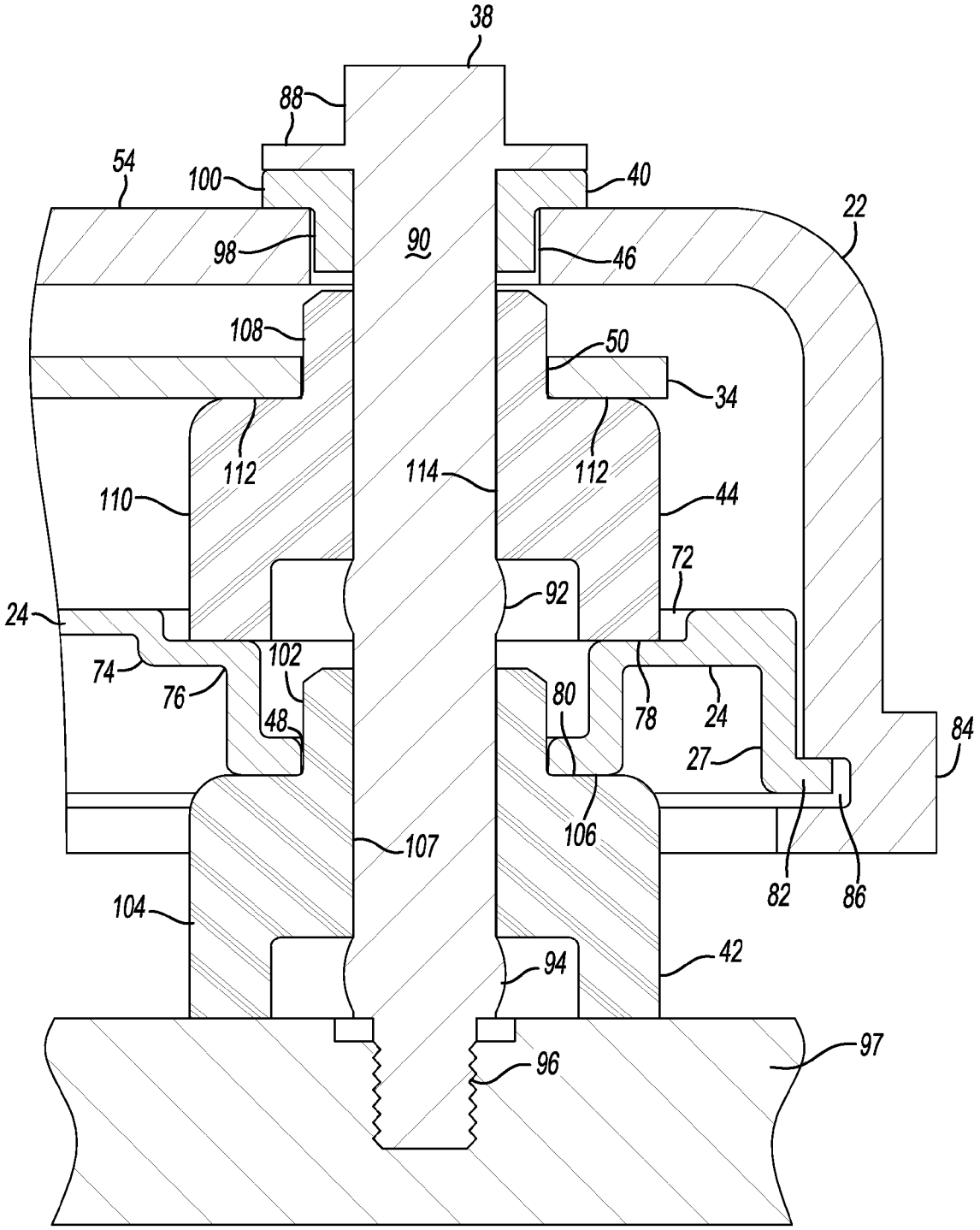
FIG. 6 is a cross-sectional view of an alternate mounting configuration of a shoe member of the sound enclosure of FIG. 1

FIG. 6 is an example illustration of the mounting assembly 18. The mounting assembly 18 includes the fastener 38, the first isolation member 40, the second isolation member 42, and the third isolation member 44. The shoe member 22 defines the first aperture 46. The base 24 defines the second aperture 48, and the lower shell member 34 defines a third aperture 50. The base 24 is located below the lower shell member 34, locating lower shell member 34 axially between the generally planar portion 54 and the base 24. The base 24 may include a mounting region 72 defining the second aperture 48 surrounded by first and second annular stepped regions 74, 76. The first stepped region 74 may form a first seating surface 78 and the second stepped region 76 may form a second seating surface 80. The outer contact area 27 of the base 24 may include a radially extending portion 82. The outer perimeter 84 of the shoe member 22 may form an annular grove 86. In one arrangement, the radially extending portion 82 of the base 24 nests into the annular groove 86 in the assembled state of the sound enclosure 14.

Isolation members 40, 42 and 44 may be formed from a flexible material such as an elastomer. By way of non-limiting example, first, second and third isolation members 40, 42, and 44 may include grommets and may be formed from a material including ethylene propylene diene monomer (EPDM), neoprene, or any other suitable grommet material. Fastener 38 may include a head 88 having a shank 90 extending therefrom. Shank 90 may include first and second radial protrusions 92, 94 axially spaced from one another and a threaded region 96 at an end of shank 90 generally opposite head 88. In an assembled state, the fastener 38 may extend through the first, second, and third isolation members 40, 42, 44 and the first, second, and third apertures 46, 48, 50 such that the threaded region 96 engages with a mounting structure 97, securing the compressor assembly 10 thereto.

A portion of the first isolation member 40 may be located within the first aperture 46 of shoe member 22. The first isolation member 40 may include a first portion 98 extending axially within a portion of the first aperture 46 and a second portion 100 may extend radially outward relative to first portion 98 and may be located axially between head 88 and generally planar portion 54 of sound enclosure 14.

The second isolation member 42 may include first and second portions 102, 104. First portion 102 may have an outer diameter less than an outer diameter of second portion 104. The first portion 102 and the second portion 104 may form a stepped region defining a seating surface 106. The first portion 102 may be located within the second aperture 48 of base 24. The second portion 104 may abut second seating surface 80 of base 24. More specifically, seating surface 106 of the second isolation member 42 may abut second seating surface 80 of base 24. Furthermore, the side of the second portion opposite the seating surface 106 may abut the mounting structure 97. The second isolation member 42 may include a bore 107 receiving shank 90. The first portion 102 of the second isolation member 42 may have an inner diameter less than the diameter of second protrusion 94 of fastener 38 and the second portion 104 may have an inner diameter greater than the diameter of second protrusion 94.

The third isolation member 44 may include first and second portions 108, 110. The first portion 108 may have an outer diameter less than an outer diameter of the second portion 110 forming a stepped region defining a seating surface 112 on the second portion 110. The lower shell member 34 may abut the seating surface 112. The second portion 110 may rest on the first seating surface 78 of the base 24. More specifically, the side of the second portion 110 opposite the seating surface 112 may abut the first seating surface 78 on the base 24. The third isolation member 44 may include a bore 114 receiving the shank 90. The first portion 108 of the third isolation member 44 may have an inner diameter less than the diameter of first protrusion 92 of fastener 38 and the second portion 110 may have an inner diameter greater than the diameter of first protrusion 92.

The foregoing description of the arrangements has been provided for purposes of illustration and description. It is not intended to be exhaustive or to limit the disclosure. Individual elements or features of a particular arrangement are generally not limited to that particular arrangement, but, where applicable, are interchangeable and can be used in a selected arrangement, even if not specifically shown or described. The same may also be varied in many ways. Such variations are not to be regarded as a departure from the disclosure, and all such modifications are intended to be included within the scope of the disclosure.

Example implementations are provided so that this disclosure will be thorough, and will fully convey the scope to those who are skilled in the art. Numerous specific details are set forth such as examples of specific components, devices, and methods, to provide a thorough understanding of the present disclosure. It will be apparent to those skilled in the art that specific details need not be employed, that example arrangements may be embodied in many different forms, and that neither should be construed to limit the scope of the disclosure. In some example arrangements, well-known processes, well-known device structures, and well-known technologies are not described in detail.

When an element or layer is referred to as being "connected to" or "coupled to" another element or layer, it may be directly on, engaged, connected, or coupled to the other element or layer, or intervening elements or layers may be present. As used herein, the term "and/or" includes any and all combinations of one or more of the associated listed items.

Although the terms first, second, third, etc. may be used herein to describe various elements, components, regions, layers, and/or sections, these elements, components, regions, layers, and/or sections should not be limited by these terms. These terms may simply be used to distinguish one element, component, region, layer or section from another component, region, layer or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example.

What is claimed is:

1. A sound enclosure for enclosing a compressor assembly in an assembled state, the sound enclosure comprising:

at least one cover piece;

a shoe member including a partial circumferential wall projecting upright from a generally planar portion, wherein one of the partial circumferential wall or the cover piece has a projected portion and the other of the partial circumferential wall or the cover piece has a recessed portion, whereby in an assembled state the projected portion nests into the recessed portion;

a base including an outer contact area wherein the shoe member includes an outer perimeter, whereby in the assembled state the outer contact area is in contact with the outer perimeter of the shoe member; and a mounting assembly comprising:

a fastener; and a first isolation member, wherein the shoe member defines a first aperture and the base defines a second aperture, whereby in a mounted state the fastener extends through the first isolation member and secures the sound enclosure to a mounting structure such that the first isolation member is disposed between the mounting structure and the base and isolates the mounting structure from the base.

2. The sound enclosure of claim 1 wherein the shoe member includes first and second shoe members each having a joint area wherein one of the joint area of the first shoe member or the joint area of the second shoe member has an extending portion and the other of the joint area of the first shoe member or the joint area of the second shoe member has a depressed portion, whereby in the assembled state the extending portion nests into the depressed portion.

3. The sound enclosure of claim 2 wherein the first shoe member includes a first partial circumferential wall projecting upright from a first generally planar portion and the second shoe member includes a second partial circumferential wall projecting upright from a second generally planar portion, wherein the extending portion is formed on both of the first partial circumferential wall and the first generally planar portion and the depressed portion is formed on both of the second partial circumferential wall and second generally planar portion.

4. The sound enclosure of claim 3 wherein the first partial circumferential wall overlaps the second partial circumferential wall at the joint area and wherein the at least one cover piece overlaps the first partial circumferential wall at the joint area.

5. The sound enclosure of claim 2 wherein (i) one of a portion of the partial circumferential wall or a portion of the cover piece; (ii) one of a portion of the outer contact area or the outer perimeter, and (iii) one of the extending portion or depressed portion of the joint area is lined with isolating material.

6. The sound enclosure of claim 1 wherein the outer contact area of the base includes a radially extending portion and the outer perimeter of the shoe member defines an annular groove whereby in the assembled state the radially extending portion nests into the annular groove.

7. The sound enclosure of claim 1 wherein the at least one cover piece includes a first cover piece and a second cover piece, whereby in the assembled state the first and second cover pieces are fastened to each other.

8. The sound enclosure of claim 7, further comprising at least one mechanical fastener that couples the first and second cover pieces together.

9. The sound enclosure of claim 1 wherein the at least one cover piece is coupled to the shoe member.

10. A compressor assembly comprising:

the sound enclosure of claim 1;

a hermetic shell including a lower shell member defining a third aperture, wherein the mounting assembly further comprises:

second and third isolation members, whereby in the mounted state the fastener extends through the second and third isolation members such that a portion of the second isolation member is located within the first aperture and isolates the fastener from the shoe member, a portion of the first isolation member is located within the second aperture and isolates the base from the fastener, a portion of the third isolation member is located within the third aperture and isolates the lower shell member from the fastener and the base.

11. The sound enclosure of claim 10 wherein in the assembled state the interior surface of the at least one cover piece is lined with a sound attenuating material.

12. The sound enclosure of claim 11 wherein in the assembled state the interior surface of the shoe member is lined with a sound attenuating material.

13. The compressor assembly of claim 1 wherein the first isolation member is made of an elastomer material.

14. A sound enclosure for enclosing a compressor assembly in an assembled state, the sound enclosure comprising:

at least one cover piece;

a shoe member including a partial circumferential wall projecting upright from a generally planar portion, wherein one of the partial circumferential wall or the cover piece has a projected portion and the other of the partial circumferential wall or the cover piece has a recessed portion, whereby in an assembled state the projected portion nests into the recessed portion; and a base including an outer contact area wherein the shoe member includes an outer perimeter, whereby in the assembled state the outer contact area is proximate to the outer perimeter of the shoe member;

wherein the shoe member includes first and second shoe members each having a joint area wherein one of the joint area of the first shoe member or the joint area of the second shoe member has an extending portion and the other of the joint area of the first shoe member or the joint area of the second shoe member has a depressed portion, whereby in the assembled state the extending portion nests into the depressed portion; and wherein a first isolating material is disposed between the partial circumferential wall and the cover piece.

15. The sound enclosure of claim 14 wherein a second isolating material is disposed between the outer contact area and the outer perimeter.

16. The sound enclosure of claim 15 wherein a third isolating material is disposed between the extended portion and the depressed portion.

17. The sound enclosure of claim 16 wherein in the assembled state the interior surface of the at least one cover piece is lined with a sound attenuating material.

18. The sound enclosure of claim 17 wherein in the assembled state the interior surface of the shoe member is lined with a sound attenuating material.

19. The sound enclosure of claim 18 wherein the sound attenuating material is fiber glass insulation or polystyrene.

* * * * *